United States Patent [19]

Stein

[11] 4,245,593

[45] Jan. 20, 1981

[54] LIQUID HEATING AND CIRCULATING SYSTEM

[75] Inventor: John Stein, Spokane, Wash.

[73] Assignee: Kim Hotstart Manufacturing Co., Inc., Spokane, Wash.

[21] Appl. No.: 71,982

[22] Filed: Sep. 4, 1979

Related U.S. Application Data

[63] Continuation of Ser. No. 906,993, May 18, 1978, abandoned.

[51] Int. Cl.[3] ..... F02N 17/02

[52] U.S. Cl. ..... 123/142.5 R; 123/142.5 E; 123/196 AB; 165/107 R; 165/42; 165/51

[58] Field of Search ..... 123/142.5 R, 142.5 E, 123/196 AB, 41.33, 41.14; 165/107, 42, 51; 184/104 A

[56] References Cited

U.S. PATENT DOCUMENTS

| | | | |
|---|---|---|---|
| 2,070,615 | 2/1937 | Plante | 123/142.5 R |
| 2,623,612 | 12/1952 | Scheiterlein | 184/104 A |
| 3,134,374 | 5/1964 | Stevens | 123/142.5 E |
| 3,236,220 | 2/1966 | Holmes | 123/142.5 R |
| 3,373,728 | 3/1968 | Collins | 123/142.5 R |
| 3,400,700 | 9/1968 | Lindsey et al. | 123/142.5 R |
| 3,758,031 | 9/1973 | Moran | 123/142.5 R |
| 3,795,234 | 3/1974 | Stolz | 123/142.5 R |
| 3,853,270 | 12/1974 | Pubil | 123/142.5 R |
| 4,051,825 | 10/1977 | Elder | 123/142.5 R |

FOREIGN PATENT DOCUMENTS 7706060 12/1977 Netherlands .

*Primary Examiner*—Ira S. Lazarus

*Attorney, Agent, or Firm*—Wells, St. John & Roberts

[57] ABSTRACT

A method and apparatus for maintaining equipment, such as an engine, in readiness for use while it is otherwise nonoperational. The equipment or engine is of the type having a closed liquid recirculation system. The present method and apparatus bypasses the usual recirculating pump in this system. An external supply power removes liquid from the sump or reservoir, and diverts the liquid from passage through the normal recirculating pump of the recirculating system. The diverted liquid is conditioned to a predetermined temperature by passage through a heat exchanger. It is pressurized by operation of the supply pump. It is then directed into the equipment recirculation system downstream from the outlet of the system's recirculating pump. The pressurized and temperature conditioned liquid is then forced through the equipment passages in the recirculation system. This maintains the equipment at a temperature in readiness for use. In the case of a lubrication liquid system, it also maintains proper lubrication of the equipment elements during periods in which the equipment is not being used.

13 Claims, 5 Drawing Figures

LIQUID HEATING AND CIRCULATING SYSTEM

This is a continuation of application Ser. No. 906,993, filed May 18, 1978, now abandoned.

BACKGROUND OF THE INVENTION

This invention relates to the maintenance of idle equipment, such as internal combustion engines. Such equipment must often be used in environments which impose temperature levels on the equipment that are extremely different from the normal operating temperatures of the equipment. For instance, internal combustion engines used outdoors in northern climates through the winter are often exposed to subzero temperatures. Were the equipment to be stored at such temperatures, starting of the equipment might be impossible. At best, starting would be difficult and would subject the movable elements of the equipment to extraordinary wear. It is well known that lubrication fluids in nonoperational equipment such as engines experience a decrease in viscosity at lowered temperatures and also tend to drain from bearings and other lubricated surfaces over extended periods of time unless the equipment is periodically operated.

To counter these problems, many users of mechanical equipment in hostile or cold environments must maintain the equipment operational at all times. Internal combustion engines used outdoors are often operated or idled continuously to assure proper heating and lubrication of the equipment between periods of actual usage. Alternatively, many users of equipment such as engines, heat and pump coolant liquid through the equipment when it is not in use. Electrically heated elements and percolating heaters and valve arrangements for circulating coolant liquids through engine blocks are well known. However, heating the coolant is not satisfactory in the case of many heavy-duty engines, because the large aluminum pistons sometimes present in such engines draw such quantities of heat from the engine block that it is almost impossible to maintain a block temperature adequate to assure subsequent starting.

Another limitation of heaters that circulate coolant liquid through the block of an engine or through other equipment, is that this usually has little or no effect on its lubricating system. In an engine, the oil or lubricant normally drains by gravity to a lower pan or sump beneath the engine elements. Simply heating the engine block has little or no effect on the cold lubricant in the exposed pan beneath the block. Separate pan heaters are needed. Heating the engine block by circulating coolant fluid and heating lubricant stationary in an engine pan obviously has no lubricating effect on the engine components themselves while the engine is not in use.

The present invention was developed in an effort to maintain equipment such as internal combustion engines in operational readiness by circulating coolant or lubricating liquids through the equipment in much the same fashion as they are circulated when the equipment is operational. By substantially matching the operational circulation of such liquids, the machine elements are prelubricated when the liquid being circulated is the usual lubrication liquid. The lubricating fluid is maintained in a warm condition and the lubricated surfaces are maintained with a film of lubricant in readiness for subsequent movement. This is achieved while the normal equipment elements are stationary, and requires only a fraction of the energy that would otherwise be necessary to operate the equipment at an idle condition when not in use. Furthermore, this substantially reduces the wear on the equipment elements, since they can remain stationary while being warmed and/or lubricated.

DESCRIPTION OF THE PREFERRED EMBODIMENT

Figure 1:
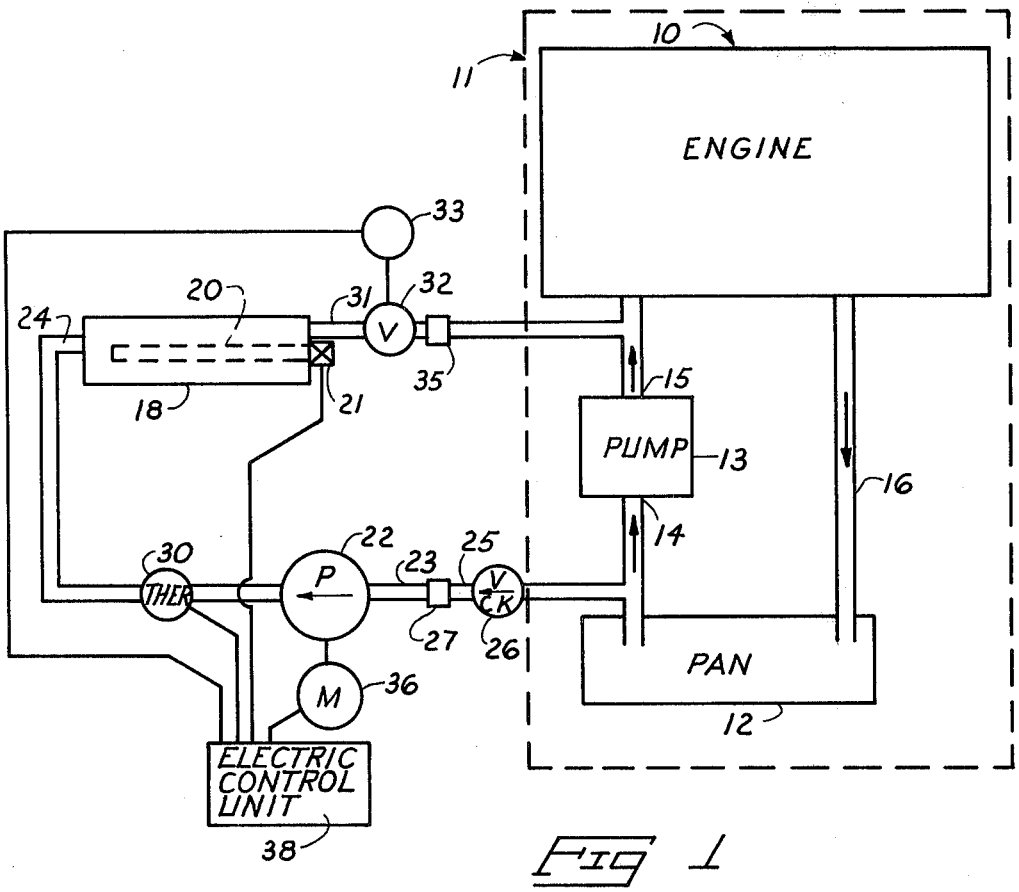
FIG. 1 is a schematic diagram of the present apparatus.
Figure 2:
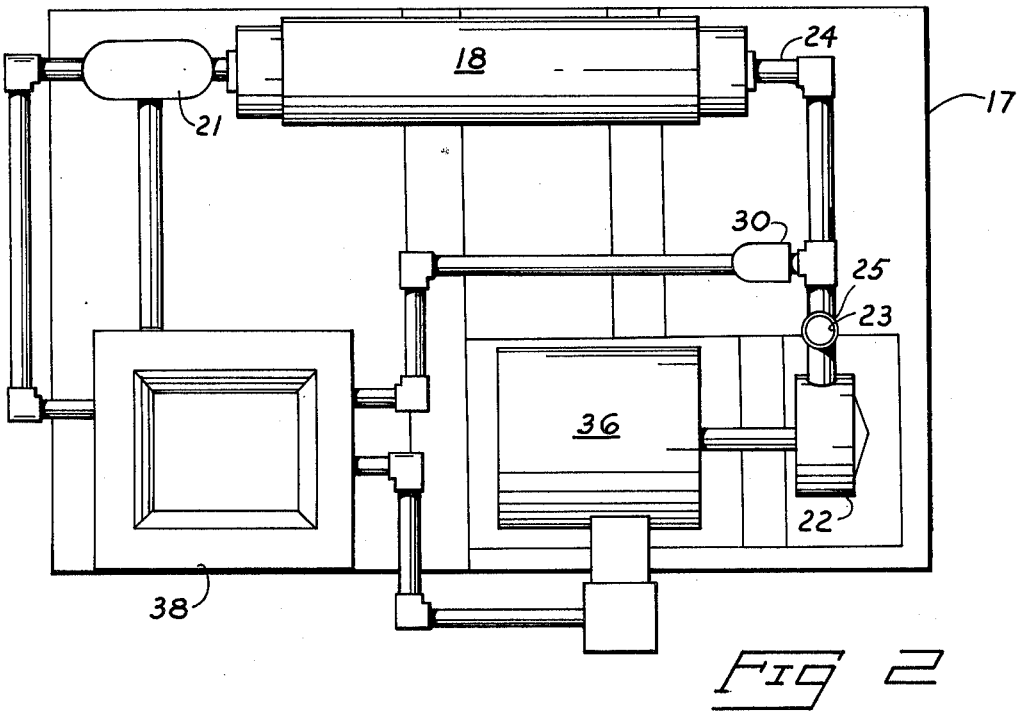
FIG. 2 is an elevation view of the apparatus.
Figure 3:
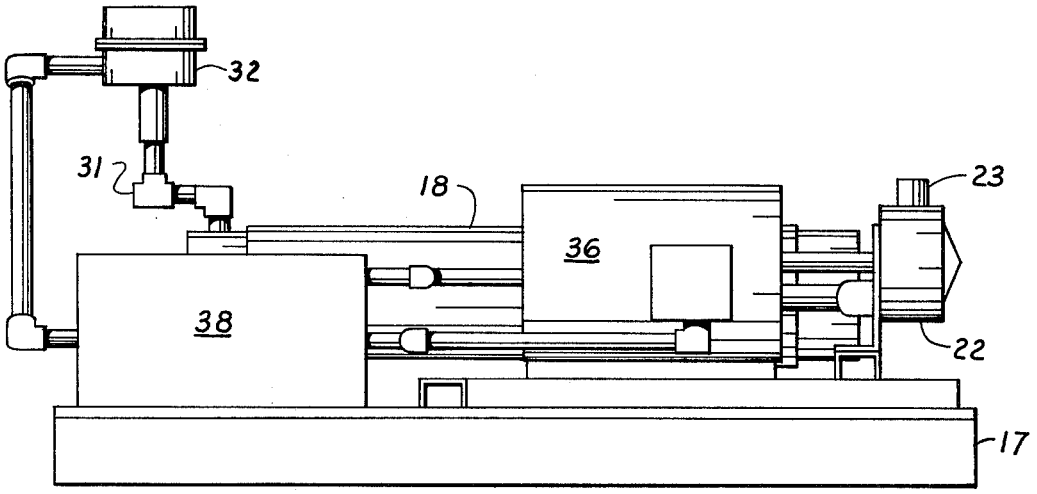
FIG. 3 is a plan view of the apparatus.
Figure 4:
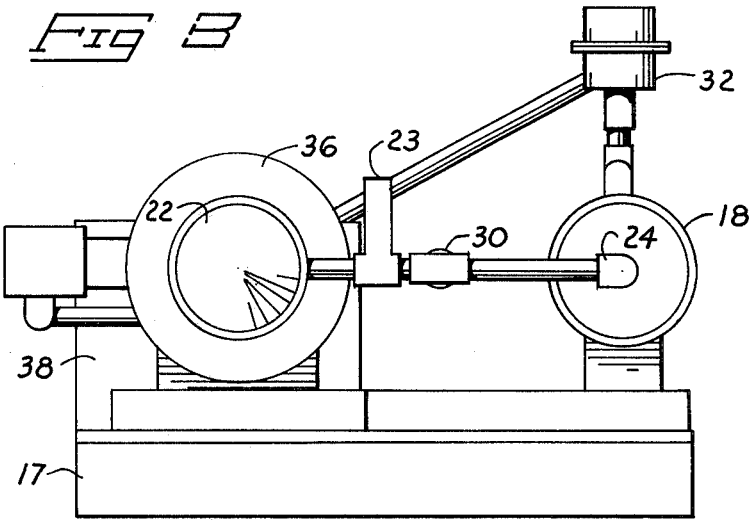
FIG. 4 is a right hand end view of the apparatus in FIG. 2.
Figure 5:
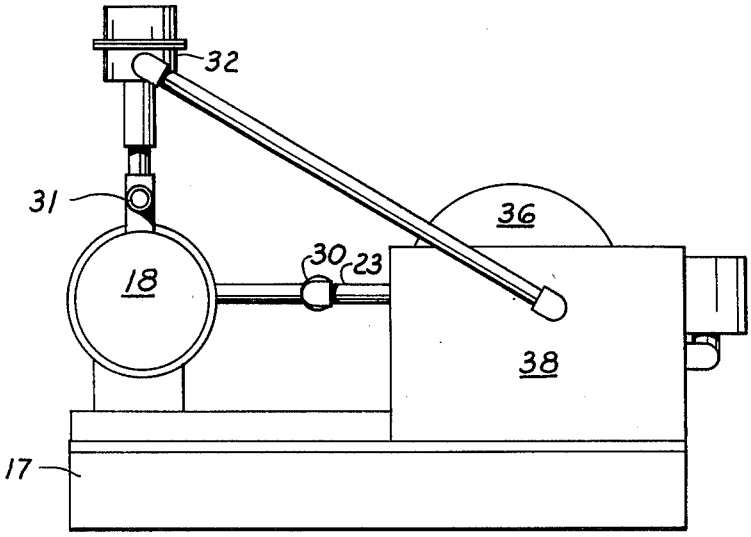
FIG. 5 is a left hand end view of the apparatus in FIG. 2.

The invention is disclosed with respect to an internal combustion engine, which might be a natural gas, diesel or gasoline powered engine of any conventional type. The engine might be in a stationary location, such as in a power plant, or might be located in a vehicle, such as an automobile, truck or railroad locomotive. The type of equipment or engine and its normal application during usage are irrelevant to an understanding of this invention. Furthermore, the method and apparatus described herein are applicable to other types of equipment, as well as to engines. For instance, they might be used to circulate fluid through systems used in the chemical industries, such as a scrubber. In such an application, the method and apparatus might be used to either extract heat from a liquid while the equipment is idle, or to add heat to the liquid.

As a general statement, the method and apparatus are applicable to equipment of the type including a closed liquid recirculation system, having a liquid supply and a recirculating pump including a pump outlet and inlet. The details of the closed liquid recirculation system are not necessary to an understanding of this invention. In such a closed liquid recirculation system, various stationary or moving elements in the equipment are normally supplied with a recirculating liquid that is pressurized by operation of a recirculating pump. This pump is operational when the equipment is operational. It draws the fluid from a liquid supply, pressurizes it by pumping, passes the pressurized fluid through the equipment, and allows the liquid to return to the supply for subsequent use. The liquid supply can be integral to the equipment or can be separate from it and connected by appropriate conduits. Various filters and other types of liquid conditioning devices can be interposed in the recirculation system.

In general, the present method includes the steps of removing liquid from the liquid supply of the equipment and diverting the removed liquid to the intake of a supply pump external to the equipmen This step bypasses the recirculating pump of the equipment, which is not operational when the equipment itsen is not in use. The method involves the further step of conditioning the diverted liquid to a constant temperature by passage through a heat exchanger. The heat exchanger either adds heat to the liquid or extracts heat from it, depending upon whether heating or cooling of the liquid is desired. The diverted liquid, which is pressurized by operation of the supply pump, is subsequently redirected into the closed liquid recirculation system of the equipment under pressure. The conditioned liquid is inserted into the recirculation system under such pressure at a location downstream from the usual outlet of the recirculating pump. While not essential, it is generally desirable that the removal of the liquid from the liquid supply be accomplished at a location in the system close to the inlet of the recirculating pump thereof, and that the insertion of the conditioned liquid into the system be accomplished at a location close to the outlet of the recirculating pump.

This method is designed to simulate operation of the equipment so far as the liquid recirculation system itself is concerned. The pressure, temperature and rate of flow of the liquid are such as to assure continuous liquid circulation through the equipment while the equipment elements are not in use. In the case of an internal combustion engine, the liquid can be either a coolant liquid, or more preferably, lubricating oil or fluid. By heating the lubricant, and distributing it through the normal lubrication system of an engine, one can not only maintain the engine block in a warm condition despite cold outdoor temperatures, but can also assure the continued presence of adequate lubrication films on bearing surfaces for starting of the engine without undue wear or difficulty.

The method will be better understood by reference to the drawings, which disclose details of an exemplary apparatus for carrying out the above steps. The apparatus is schematically illustrated in FIG. 1. A typical physical embodiment of the apparatus is shown in FIGS. 2 through 5.

Referring to FIG. 1, the equipment with which the apparatus is used is illustrated as generally comprising an internal combustion engine schematically shown at 10. The elements of engine 10 comprise part of a closed liquid recirculation system schematically indicated as being within dashed line boundaries 11. The recirculation system 11 further includes a liquid supply or sump 12. In the case of an internal combustion engine, the liquid supply 12 will be the usual pan beneath the engine, which collects the lubricant oil after its passage through the various engine elements.

The system 11 also includes a recirculating pump 13. Again, in the case of an internal combustion engine, pump 13 is an oil pump powered during use of engine 10 and idle when engine 10 is not operational. Pump 13 basically has an inlet 14 in fluid communication with the liquid supply 12, and an outlet 15, which directs pumped lubricant under pressure to the various elements of engine 10.

For purposes of illustration, the schematic diagram also shows a conduit 16 for returning liquid to the liquid supply 12. The purpose is to visually illustrate the complete recirculating system. In the case of an internal combustion engine, the liquid supply 12 is usually a pan beneath the engine. The engine components are open to the pan and the lubricant oil drops in to the pan from many different portions of the engine as it flows downward through the engine block and elements.

In any case, while the equipment is operational, the recirculating pump 13 supplies liquid from the liquid supply 12 or sump to the elements of the equipment in a continuous recirculating fashion. Various filters or other conditioning devices (not shown) can be interposed within the system in the usual fashion.

Referring again to FIG. 1, the present apparatus is shown to the left of the recirculation system 11 for equipment 10. It comprises a conditioning tank 18 or heat exchanger within which liquid can be either heated or cooled. It also comprises a supply pump 22 which is external to the equipment and independently powered by a motor 36. Pump 22 includes an inlet 23 operatively connected to the liquid supply 12 and an outlet 24 operatively connected to the conditioning tank or heat exchanger 18. The conditioning tank 18 has an outlet operatively connected to the liquid recirculation system 11 by means of a discharge conduit 31. When in use, pump 22 removes liquid from supply 12, diverts it through the conditioning tank 18, and directs the conditioned liquid under pressure back into the recirculation system 11. The pressurized liquid then continues through equipment 10 in the same fashion as when it is circulated during operation of equipment 10. The liquid stream can be used for heating, cooling and/or lubrication of equipment 10 so as to maintain it in readiness for subsequent use in any environment.

The details of the apparatus are shown more clearly in FIGS. 2 through 5. As illustrated, the apparatus can be mounted upon a supporting frame or pallet 17. This frame 17 can be portable or stationary, depending upon the manner in which the equipment is being used. As an example, the frame 17 might be maintained outdoors in a stationary position for attachment to portable vehicles, such as trucks or railroad locomotives. Alternatively, the frame or pallet 17 might be portable and readily moved or carried to the location of the equipment with which it is to be utilized.

The conditioning tank 18 is shown as an elongated cylindrical tank having an inlet at one end and an outlet at the other for continuous flow of liquid through the length of the tank. Tank 18 is illustrated as containing a coaxial elongated heating element 20. This might be an electrical resistance heating element operated by a heater control 21 mounted to one end of the tank 18. However, it is to be understood that the tank 18 might have many other physical configurations, and might be heated or cooled by means external to it, as well as by an internal element as shown.

Pump 22 is a conventional rotary pump. Pump 22 includes an inlet 23 and an outlet 24. Other types of suitable circulation pumps can be substituted. Motor 36 is shown as an electric motor, but can be a small internal combustion engine if the unit is used where electric power is not readily available.

Inlet conduit 25 operatively connects the inlet 23 of pump 22 to the liquid supply 12 of the equipment recirculation system 11. Since this apparatus is used only when the equipment 10 is nonoperational, it is desirable that it be readily disconnected from the equipment. This is particularly needed in the case of equipment of a portable nature, such as a truck engine. This can be accomplished by a releasable coupler 27 of the type conventionally used for disconnecting hoses to mechanical equipment. A check valve 26 is preferably interposed within inlet conduit 25. Check valve 26 permits flow of liquid toward inlet 33 but prevents reverse flow. In normal installations, check valve 26 will remain as part of the recirculation system 11, automatically assuring that normal operation of equipment 10 will have no effect on the auxilliary equipment that maintains it in readiness for use.

An outlet conduit 28 extends from pump outlet 24 to the inlet of the conditioning tank 18. Interposed in the conduit 28 is a thermostatic element 30 that monitors the temperature of the liquid flowing through conduit 28.

A final discharge conduit 31 extends from the outlet of conditioning tank 18 to the recirculation system 11. It is directed to a point in the system reasonably close to the outlet of the equipment's recirculating pump 13. A flow control valve 32 and associated flow control switch 33 is interposed within conduit 31 adjacent to the outlet of the conditioning tank 18. A coupler 35 releasably connects the outlet of tank 18 to the pressure side of pump 13.

The various components of the apparatus can be electrically controlled to provide automatic monitoring of its operation and thermostatic control of the temperature of the liquid being circulated through the system 11. Suitable electric controls are schematically illustrated at 38. The controls 38 are electrically connected to motor 36, heating element 20, thermostatic element 30, and flow control switch 33.

Under normal use, the thermostatic element 30 is preset to the temperature at which the liquid is desired. Until the circulating liquid reaches this temperature, the thermostatic element 30 will continue operation of heating element 20 to add heat to the liquid system. When the desired temperature has been reached, heating element 20 will be turned off until the liquid temperature again falls below this predetermined temperature level.

To insure against damage to the heating element due to lack of liquid recirculation, the flow control switch 33 monitors the passage of liquid through the conditioning tank 18. So long as flow continues, the switch 33 remains inactive. It is activated by lack of flow through discharge conduit 31. This activation is used to immediately open the circuit to the heating element 20 to prevent damage to it and to prevent damage to the liquid within conditioning tank 18, which might be very sensitive to heat. Should flow be only momentarily interrupted, the switch 33 will be deactivated and the circuit to heating element 20 will again be completed through operation of the controls at 38. However, the controls 38 should include a time delay circuit to monitor activation of the flow control switch 33. If flow has ceased for a predetermined time, the controls 38 will then shut down the entire apparatus and require manual restarting of it. In this way, operation of the apparatus can be automatically monitored, while assuring that there will be no damage to the fluid being circulated, nor to the equipment 10.

The purpose of the apparatus is to provide circulation of the liquid, such as lubricant oil, through the equipment 10 while the equipment 10 is not operational. The pump 22 is preset to direct liquid to the system 11 at a pressure similar to the normal operating pressure encountered within it during its use. The thermostatic control 30 is set in conjunction with the element 20 within conditioning tank 18 to either heat or cool the liquid to a temperature similar to its normal operating temperature. The flow control valve 32 is preselected or adjusted to assure that the rate of flow of the liquid through the system 11 will simulate normal operating conditions. Thus, lubricating oils, coolants or other liquids can be continuously circulated through the nonoperational equipment to effect heat transfer to the equipment elements while the equipment is not in use. If the liquid is a lubricating fluid, surface lubrication is also effected, maintaining the movable elements of the equipment in readiness for starting and subsequent use without the normal wear encountered between movable surfaces that have remained stationary for substantial periods of time and which require proper lubrication.

Various modifications might be made with respect to the details of the equipment, while remaining within the boundaries of the apparatus and method discussed above. For these reasons, the following claims are set out as definitions of the disclosed invention.

Having described my invention, I claim:

1. An apparatus for maintaining an engine in readiness for use while nonoperational, wherein the engine includes a closed liquid recirculation system having a liquid supply and a recirculating pump, the recirculating pump being adapted to direct pressurized liquid through the system while the engine is operational; said apparatus comprising:

a supply pump having an inlet and an outlet;

motor means operatively connected to the supply pump for driving the pump so as to impart a predetermined pressure to liquid at the pump outlet when said motor means is operating;

a supply conduit adapted to be operatively connected between the pump inlet and the liquid supply of the closed liquid recirculation system of the engine;

a heat exchanger having an inlet and an outlet;

said heat exchanger including heating element means for transferring heat to liquid passing through the heat exchanger between its inlet and outlet;

said inlet of the heat exchanger being in open communication with the outlet of the supply pump;

and a delivery conduit adapted to be operatively connected between the outlet of the heat exchanger and the closed liquid recirculation system of the engine at a location downstream from the recirculating pump thereof.

2. An apparatus as set out in claim 1, further comprising:

a thermostatic switch operatively connected to the supply pump outlet for monitoring the temperature of liquid at the pump outlet, said thermostatic switch being operatively connected to said heating element means.

3. An apparatus as set out in claim 1, further comprising:

flow control valve means operatively connected to the outlet of said heat exchanger for limiting the rate of flow of liquid between the heat exchanger and the closed liquid recirculation system of the engine.

4. A method of maintaining equipment in readiness for use while the equipment is nonoperational, the equipment being of the type including a closed liquid recirculation system having a liquid supply and a recirculating pump including a pump inlet and outlet;

the recirculating pump being adapted to direct pressurized liquid through the system while the equipment is operational;

said method comprising the following steps:

removing liquid from the liquid supply;

diverting the removed liquid to the intake of a supply pump external to the equipment to bypass the recirculating pump thereof;

conditioning the diverted liquid to a constant temperature by passage of it through a heat exchanger;

pressurizing the diverted liquid by operation of the supply pump to a pressure substantially equal to the normal pressure of the liquid in the closed liquid recirculation system while the equipment is operational;

and directing the conditioned liquid under pressure back into the closed liquid recirculation system of the equipment at a location downstream from the outlet of the recirculating pump.

5. A method as set out in claim 4 further comprising the following step:

limiting the rate of flow of the conditioned liquid directed into the closed liquid recirculation system of the equipment to a rate substantially equal to the normal rate of flow thereof in the closed liquid recirculation system while the equipment is operational.

6. A method of maintaining an engine in readiness for use while the engine is nonoperational, the engine being of the type including a closed liquid recirculation system having a liquid supply and a recirculating pump including a pump inlet and outlet;

the recirculating pump being adapted to direct pressurized liquid through the system while the engine is operational;

said method comprising the following steps:

removing liquid from the liquid supply;

diverting the removed liquid to the intake of a supply pump external to the engine to bypass the recirculating pump thereof;

conditioning the diverted liquid by heating it to a constant temperature by passage of it through a heat exchanger;

pressurizing the diverted liquid by operation of the supply pump to a pressure substantially equal to the normal pressure of the liquid in the closed liquid recirculation system while the engine is operational;

and directing the conditioned liquid under pressure back into the closed liquid recirculation system of the engine at a location downstream from the outlet of the recirculating pump.

7. A method as set out in claim 6 further comprising the following step:

limiting the rate of flow of the conditioned liquid into the closed liquid recirculation system of the engine to a rate substantially equal to the normal rate of flow thereof in the closed liquid recirculation system while the engine is operational.

8. A method for maintaining operational readiness of a nonoperational engine having a closed recirculating lubrication system normally supplied with a liquid lubricant under pressure from a sump, the liquid lubricant being pressurized by a circulating engine pump while the engine is operational; comprising the following steps:

inserting an external supply pump into the lubricating system to bypass the circulating pump by operatively connecting the inlet of the external pump to the sump for receiving liquid lubricant;

conditioning the liquid lubricant received from the sump by passing it through a heat exchanger to insure a constant liquid temperature;

pressurizing the liquid lubricant received from the sump by the operation of the external supply pump;

and directing the conditioned liquid lubricant into the closed recirculating lubrication system of the engine at a location immediately downstream from the circulating pump thereof, the liquid pressure and flow rate within the system being adequate to assure operational readiness of the engine components;

monitoring the temperature of the liquid lubricant at a location adjacent to the supply pump;

and operating the heat exchanger in response to the monitored temperature to thereby alter the liquid temperature.

9. An apparatus for maintaining equipment in readiness for use while nonoperational, wherein the equipment includes a closed liquid recirculation system having a liquid supply and a recirculating pump including an inlet and outlet, the recirculating pump being adapted to direct pressurized liquid through the system while the equipment is operational;

said apparatus comprising:

supply pump means external to the equipment, said supply pump means including an inlet and an outlet;

means operatively connected to the inlet of the supply pump means for selectively diverting liquid from the equipment liquid supply to bypass the recirculation pump thereof;

heat exchanger means for conditioning liquid flowing therethrough to a constant predetermined temperature, said heat exchanger means having an inlet and an outlet;

means operatively connected between the supply pump means outlet and the heat exchanger means inlet for directing liquid through the heat exchanger under pressure;

means operatively connected between the heat exchanger means outlet and the equipment at a location downstream from its recirculation pump outlet for directing the conditioned liquid under pressure through the remainder of the enclosed liquid recirculation system of the equipment;

temperature monitoring means adjacent said supply pump means for monitoring the temperature of liquid diverted to the supply pump means;

and control means operably connected to said temperature monitoring means and said heat exchanger means for operating the heat exchanger in response to the monitored temperature.

10. An apparatus as set out in claim 9 wherein said control means is preset for rendering the heat exchanger inoperative when the monitored liquid temperature equals a predetermined temperature.

11. An apparatus as set out in claim 9 further comprising:

preset flow control means interposed between the heat exchanger means outlet and the liquid circulation system of the equipment for maintaining a constant rate of flow of the liquid through the system during operation of the supply pump means.

12. An apparatus as set out in claim 9 further comprising:

preset flow control means interposed between the heat exchanger means outlet and the liquid recirculation system of the equipment for maintaining a constant rate of flow of the liquid through the system during operation of the supply pump means;

and a flow control switch operably connected to said flow control means for monitoring flow conditions through said flow control means, said flow control switch being operably connected to said heat exchanger means for rendering the heat exchanger means inoperative when the flow control switch has detected lack of flow through said control means.

13. An apparatus as set out in claim 9 further comprising:

preset flow control means interposed between the heat exchanger means outlet and the liquid recirculation system of the equipment for maintaining a constant rate of flow of the liquid through the system during operation of the supply pump means;

and a flow control switch operably connected to said flow control means for monitoring flow conditions through said flow control means, said flow control switch being connected to said heat exchanger means for rendering the heat exchanger means inoperative when the flow control switch has detected lack of flow through said control means;

and lockout control means operably connected to said flow control switch and to said heat exchanger means and to said supply pump means;

said lockout control means having a timed delay circuit for detecting lack of flow through said flow control means for a predetermined time period and for rendering both the heat exchanger means and the supply pump means inoperative at the conclusion of such predetermined time period.

* * * * *